US007034446B2

(12) United States Patent
Moore

(10) Patent No.: US 7,034,446 B2
(45) Date of Patent: Apr. 25, 2006

(54) FLUORESCENT LAMP COMPOSED OF ARRAYED GLASS STRUCTURES

(76) Inventor: Chad Byron Moore, 7 W. 4th St., Corning, NY (US) 14830

( * ) Notice: Subject to any disclaimer, the term of this patent is extended or adjusted under 35 U.S.C. 154(b) by 191 days.

(21) Appl. No.: 10/685,104

(22) Filed: Oct. 14, 2003

(65) Prior Publication Data

US 2004/0075387 A1 Apr. 22, 2004

Related U.S. Application Data

(63) Continuation-in-part of application No. 09/796,985, filed on Mar. 1, 2001, now abandoned.

(60) Provisional application No. 60/186,026, filed on Mar. 1, 2000.

(51) Int. Cl.
*H01J 1/62* (2006.01)

(52) U.S. Cl. ..... 313/483; 313/485; 313/493; 313/634

(58) Field of Classification Search ..... 313/483–485, 313/493, 582–586, 634
See application file for complete search history.

(56) References Cited

U.S. PATENT DOCUMENTS

| | | | | |
|---|---|---|---|---|
| 2,769,156 | A | 10/1956 | Caplis et al. | 339/145 |
| 2,967,965 | A | 1/1961 | Schwartz | 313/108 |
| 3,015,747 | A | 1/1962 | Rosenberg | 313/108 |
| 3,704,386 | A | 11/1972 | Cola | 313/108 R |
| 3,707,641 | A | 12/1972 | Thornton | 313/109 |
| 3,743,879 | A | 7/1973 | Kupsky | 313/108 B |
| 3,766,420 | A | 10/1973 | Ogle et al. | 313/109.5 |
| 3,790,841 | A | 2/1974 | Tsui et al. | 313/108 B |
| 3,890,609 | A | 6/1975 | Sasaki et al. | 340/324 M |
| 3,899,712 | A | 8/1975 | Witting | 313/493 |
| 4,021,695 | A | 5/1977 | Kamegaya et al. | 313/188 |
| 4,123,687 | A | 10/1978 | Poirier et al. | 313/484 |
| 5,317,232 | A | 5/1994 | Barakitis | 313/622 |
| 5,548,494 | A | 8/1996 | Blackman | 362/183 |
| 5,777,436 | A * | 7/1998 | Lepselter | 313/582 |
| 5,834,888 | A | 11/1998 | Allen et al. | 313/484 |
| 5,848,836 | A * | 12/1998 | Graber et al. | 362/223 |
| 5,984,747 | A * | 11/1999 | Bhagavatula et al. | 445/24 |
| 6,247,987 | B1 | 6/2001 | Moore | 445/24 |
| 6,331,064 | B1 | 12/2001 | Nishiyama et al. | 362/260 |
| 6,354,899 | B1 | 3/2002 | Moore | 445/25 |
| 6,414,433 | B1 | 7/2002 | Moore | 313/582 |
| 6,431,935 | B1 | 8/2002 | Moore | 445/24 |

OTHER PUBLICATIONS

Moore, Chad B. and Schaeffler, Robert. "Fiber Plasma Display." SID 1997 Digest, p. 1055-1058.

* cited by examiner

*Primary Examiner*—Vip Patel
(74) *Attorney, Agent, or Firm*—Brown & Michaels, PC

(57) ABSTRACT

The present invention uses at least one array of complex-shaped fibers that contain at least one wire electrode running the length of the glass structure to fabricate a fluorescent lamp. At least one of the complex-shaped fibers has a complex cross-section that forms a channel, which supports a plasma gas. The array of fibers can be composed flat to form a fluorescent lamp or in a cylindrical or conical shaped fluorescent lamp.

26 Claims, 13 Drawing Sheets

FLUORESCENT LAMP COMPOSED OF ARRAYED GLASS STRUCTURES

REFERENCE TO RELATED APPLICATIONS

This is a continuation-in-part of U.S. patent application Ser. No. 09/796,985, filed Mar. 1, 2001, now abandoned, entitled "FLUORESCENT LAMP COMPOSED OF ARRAYED GLASS STRUCTURES", which was disclosed in Provisional Application No. 60/186,026, filed Mar. 1, 2000, entitled "FLUORESCENT LAMP COMPOSED OF ARRAYED GLASS STRUCTURES". The benefit under 35 USC §119(e) of the United States provisional application is hereby claimed, and the aforementioned applications are hereby incorporated herein by reference.

BACKGROUND OF THE INVENTION

1. Field of the Invention

The invention pertains to the field of fluorescent lighting. More particularly, the invention pertains to using glass structures, such as complex-shaped fibers, to construct a fluorescent lamp.

2. Description of Related Art

Previous work exists in creating plasma displays using wire electrode(s) in glass fibers to produce the structure in a display. This work was initially published by C. Moore and R. Schaeffler, "Fiber Plasma Display", SID '97 Digest, pp. 1055–1058. A U.S. Pat. No. 5,984,747 GLASS STRUCTURES FOR INFORMATION DISPLAYS was granted on Nov. 16, 1999 pertaining to fiber-based displays.

A fiber-based plasma display patent application Ser. No. 09/299,370, PLASMA DISPLAYS CONTAINING FIBERS, now U.S. Pat. No. 6,414,433, issued Jul. 2, 2002, covers many different aspects of the fiber-based plasma display technology and is incorporated herein by reference. Manufacturing of fiber-based plasma displays are covered under patent application Ser. No. 09/299,350, entitled PROCESS FOR MAKING ARRAY OF FIBERS USED IN FIBER-BASED DISPLAYS now U.S. Pat. No. 6,247,987, issued Jun. 19, 2001 and Ser. No. 09/299,371, entitled FRIT-SEALING PROCESS USED IN MAKING DISPLAYS, now U.S. Pat. No. 6,354,899, issued Mar. 12, 2002. These two patents cover producing any multiple-strand arrayed display and could easily cover making multiple stand fiber-based fluorescent tubes and are incorporated herein by reference. In addition, a patent application Ser. No. 09/299,394, now U.S. Pat. No. 6,431,935, issued Aug. 13, 2002, entitled LOST GLASS PROCESS USED IN MAKING DISPLAY, teaches exposing an electrode or holding the exact fiber shape in a fiber-based plasma display and is incorporated herein by reference. Each of these patents have the same inventor as the present application.

SUMMARY OF THE INVENTION

The present invention teaches using at least one array of linear glass structures, which are preferably complex-shaped fibers, to form a fluorescent lamp. At least one surface of at least one of the complex-shaped glass fibers has a cross-section that forms a channel, which supports a plasma gas. A wire electrode is embedded in at least one of the fibers, and preferably extends over 50% of the length of the fiber. The complex-shaped fibers can be composed flat to form a fluorescent lamp or in a cylindrical or conical shaped fluorescent lamp.

DETAILED DESCRIPTION OF THE INVENTION

A "lamp" as defined and used throughout this application and understood by those skilled in the art, is a device used for illumination purposes only. A lamp is a single pixel structure (the single pixel can include three separate primary colors referred to in display language as "subpixels", which can be separately controlled, for example in a lamp to generate a multitude of colors, see FIG. 16). Since a lamp is designed to light a room or other area, it is usually run with its entire surface illuminated to the same intensity level. The frequency of the high voltage AC power being applied to the lamp can be controlled to get different illumination levels. In contrast, a "display" is a device that produces an image. In order to produce that image, a display must necessarily include multiple pixels.

A "complex-shaped fiber", as defined and shown in the present application and in the patents incorporated herein by reference (discussed above), is a linear glass structure. The fibers have a complex, non-circular cross section. These fibers are self-supporting long structures drawn from larger pieces of glass or through a die in a glass tank. These fibers also have a high aspect ratio (cross-sectional area versus length).

In its basic form, the lamp of the present invention uses at least one array of linear glass structures. The array of linear glass structures is preferably an array of complex-shaped glass fibers that contain at least one wire electrode running the length of the glass structure to fabricate a fluorescent lamp. The wire electrode is embedded within the complex-shaped glass fibers. At least one surface of the complex-shaped glass fibers is curved to form a plasma channel.

At least one of the complex-shaped fibers has a cross-section that forms a channel, which supports a phosphor layer. The lamp is preferably sealed closed using a glass frit and a plasma gas, such as Xenon or Mercury, is added to the lamp. The plasma gas generates ultraviolet light when excited, which strikes the phosphor and is converted to visible light to create fluorescence. The array of complex-shaped fibers can be composed flat to form a fluorescent lamp or in a cylindrical or conical shaped fluorescent lamp.

Figure 1:
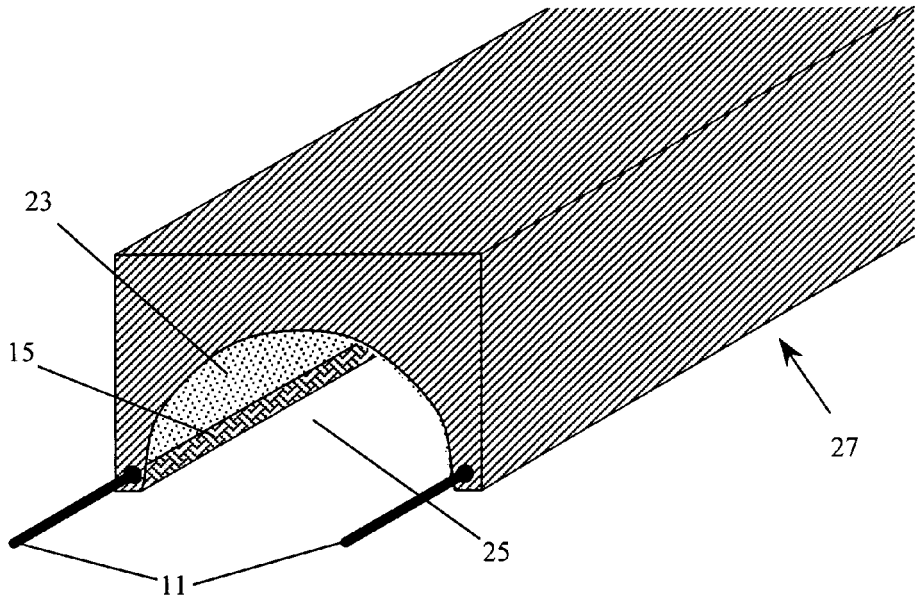
FIG. 1 schematically illustrates a complex-shaped fiber containing wire electrodes and a plasma channel to be used as part of a fluorescent lamp.

FIG. 1 schematically shows a single linear glass structure, complex-shaped fiber 27, containing wire electrodes 11. The complex-shaped fiber 27 contains an arch/channel 25 on one of its surfaces, which is coated with a phosphor layer 23. The arch/channel 25 in the glass structure is the part of the structure that supports the pressure from the low-pressure plasma gas. A hard emissive coating 15, such as magnesium oxide, is place on the surface of the structure around the wire electrodes 11 in order to increase the secondary electron emission, store charge, and lower the sustaining voltage of the fluorescent lamp.

The wire electrodes 11 contained in the glass structure can be fabricated by drawing wires into holes placed through an initial glass preform during the fiber draw process. The initial glass preforms, which have a similar cross-sectional shape to the final complex-shaped fibers 27, can be fabricated using a hot glass extrusion process. The complex-shaped fibers 27 could also be formed directly using hot glass extrusion or the shape can be drawn through a die directly from the glass melt called pulltrusion. The wire electrodes could be feed through the die during direct extrusion or drawing from a glass melt.

The wire electrodes 11 could be totally contained within the fibers 27 and the plasma inside the lamp would be capacitively coupled to them. On the other hand, the wire electrodes 11 could be designed such that they are exposed to the plasma and the plasma inside the lamp could be inductively coupled to them. One method of exposing the wire electrodes 11 to the plasma gas would be to use a lost glass process where a sacrificial or dissolvable glass is added to the glass structure 27 during its initial formation to contain the wire electrodes 11 then subsequently removed. A dissolvable glass can be co-extruded with the base glass to directly form the glass structures 27 or form a preform for the draw process. The wire electrodes 11 can be drawn into the glass structures 27 and the dissolvable glass can be subsequently removed with a liquid solution. Typical liquid solutions to dissolve the glass include vinegar and lemon juice. A dissolvable glass may be used to hold the wire electrode(s) 11 in a particular location during the draw process. When the dissolvable glass is removed the electrode (s) 11 becomes exposed to the environment outside the glass structure 27. A dissolvable glass may also be used to hold a tight tolerance in shape of the glass structure 27 during the draw process. The dissolvable glass can be removed during the draw process before the glass structures are wound onto the drum, or the glass can be removed while the glass structures are wrapped on the drum, or the glass can be removed after the glass structures have been removed from the drum as a sheet.

Figure 2:
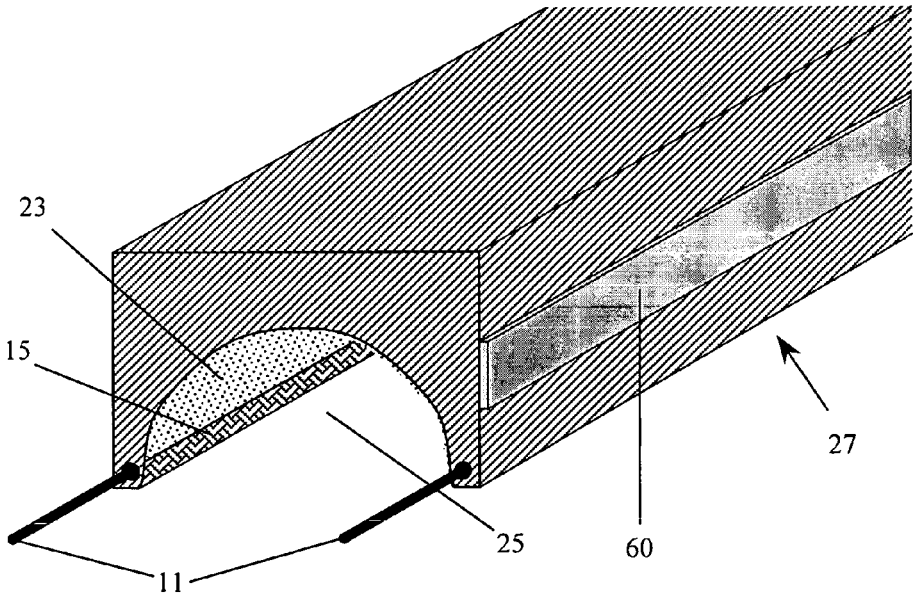
FIG. 2 schematically illustrates a structure similar to that shown in FIG. 1 with glass frit on the side of the glass fiber.
Figure 3:
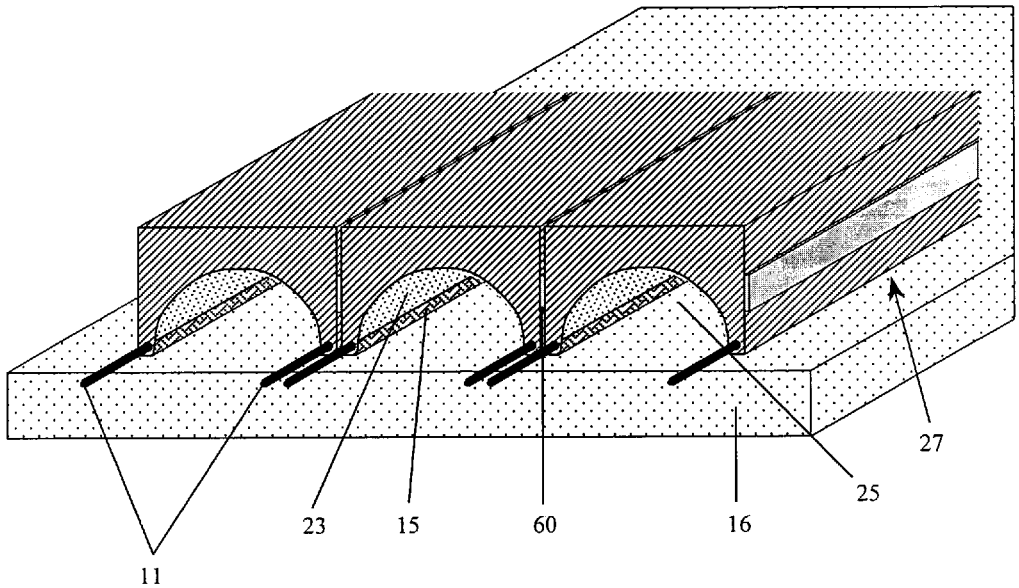
FIG. 3 schematically shows an array of complex-shaped fibers similar to that shown in FIG. 2 composed on a glass substrate.
Figure 4:
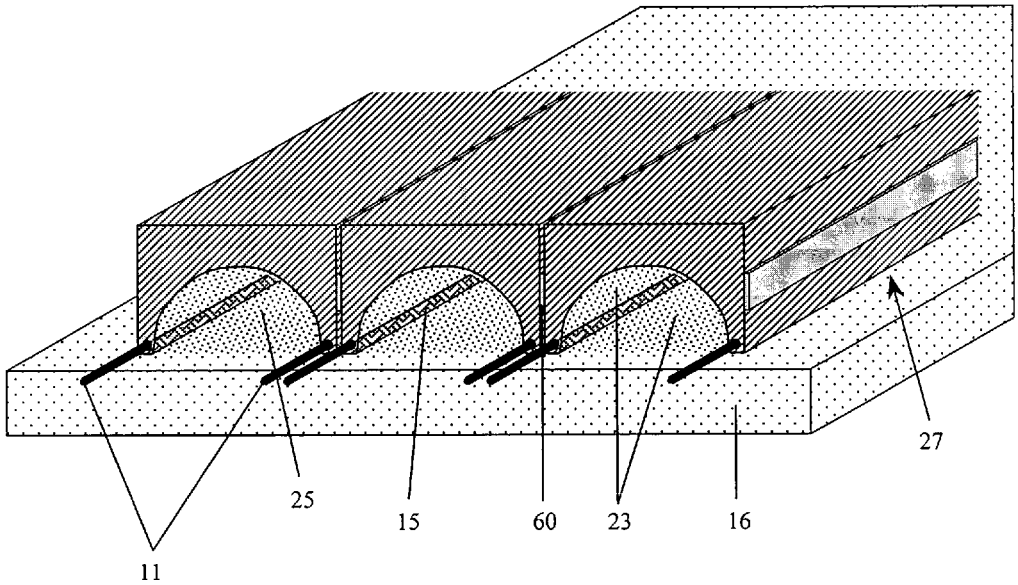
FIG. 4 schematically shows the same array of complex-shaped fibers as FIG. 3 with phosphor deposited on the glass substrate.

FIG. 2 shows that a thin glass frit layer 60 can be included on at least one side of the complex-shaped fiber 27 such that when the structures 27 are arrayed on a glass substrate 16, as shown in FIG. 3, they form a vacuum tight seal. The glass frit 60 on the side of the glass structures creating a vacuum tight seal will eliminate the need for a top glass cover sheet, hence reducing the weight and lowering the cost of the lamp. The glass substrate 16 can also be coated with a phosphor layer 23 similar to the phosphor layer 23 coated in the arch/channel 25 of the complex-shaped fibers 27, as shown in FIG. 4. Coating the glass substrate 16 with phosphor 23 will increase the usage of generated ultraviolet, UV, light by converting the UV striking the glass substrate 16 to visible light, hence increasing the efficiency and light output of the fluorescent lamp. The phosphor 23 layers can be applied to the arch/channel 25 in the complex-shaped fiber 27 and/or the glass substrate 16 using a spray process, which will uniformly and controllably coat the surfaces.

The complex-shaped fibers 27 could also be composed of a reflective glass, such as an opal glass, to reflect some of the light generated by the phosphors that would typically escape out of the back of the lamp. A highly reflective coating, such as $TiO_2$, could also be coated in the plasma channels 25 to reflect the light generated by the phosphors 23 back out of the front of the lamp.

Figure 5:
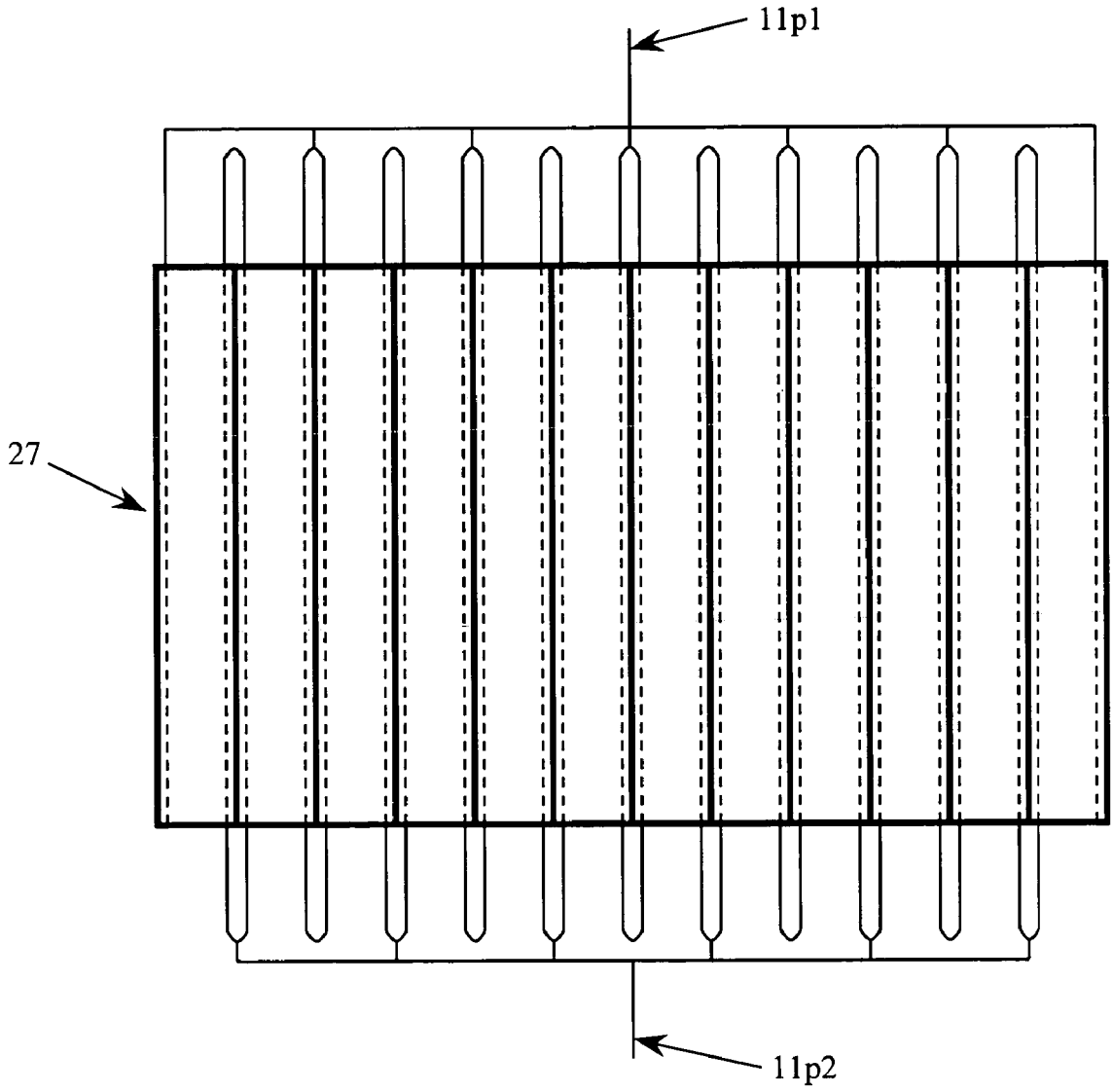
FIG. 5 is a top-view schematic of complex-shaped fibers containing wire electrodes wired-up in parallel.
Figure 6:
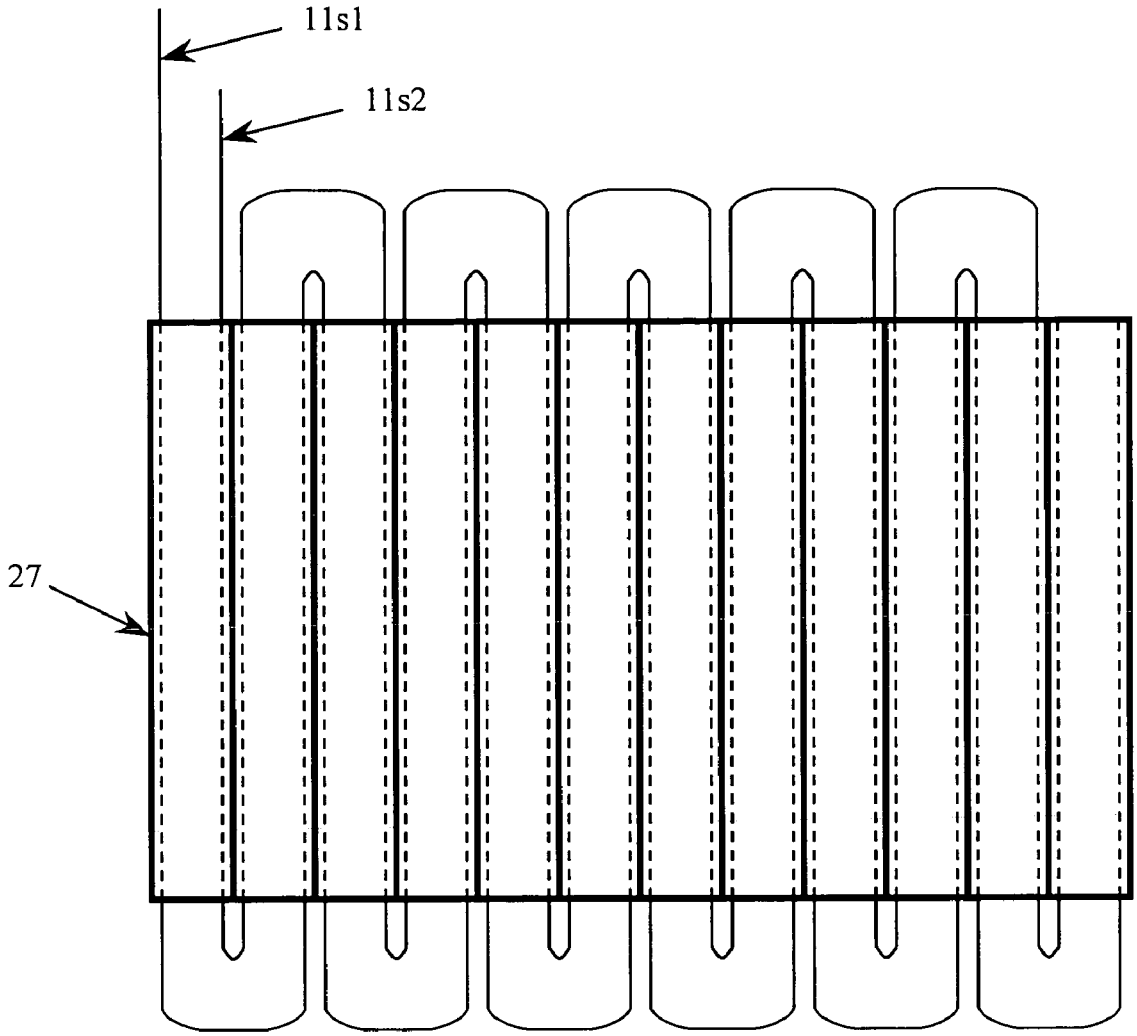
FIG. 6 is a top-view schematic of complex-shaped fibers containing wire electrodes wired-up in series.
Figure 12:
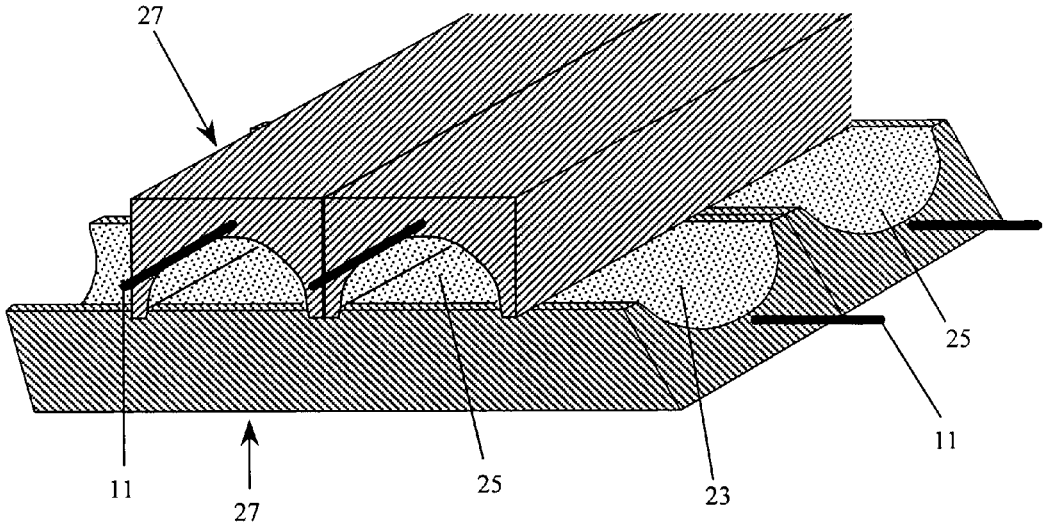
FIG. 12 schematically illustrates a fluorescent lamp composed of two orthogonal complex-shaped fiber arrays with the electrodes contained in both arrays of fibers.
Figure 14:
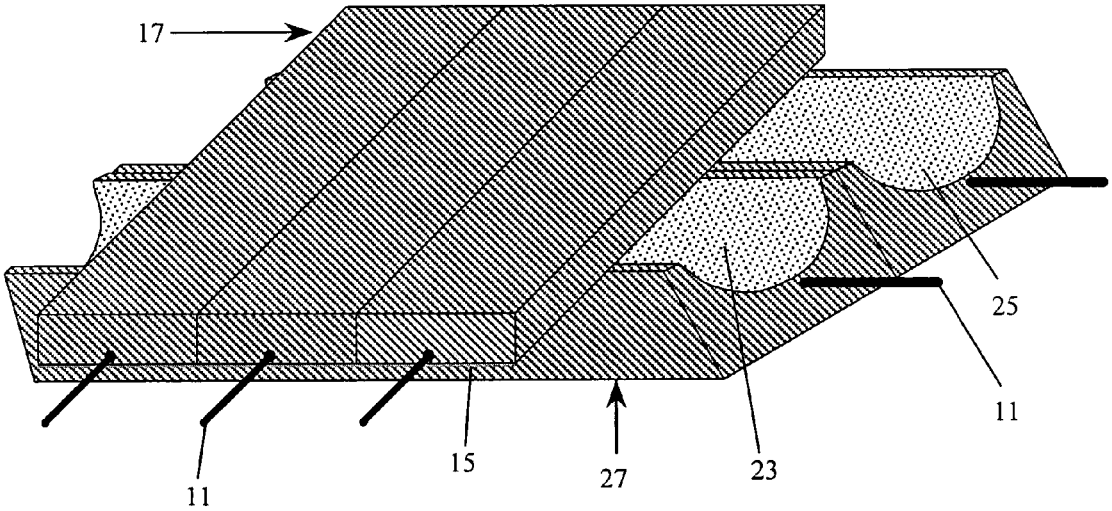
FIG. 14 schematically illustrates a fluorescent lamp composed of two orthogonal complex-shaped fiber arrays with the electrodes contained in both sets of glass structures and the plasma channel formed by only one set of the glass structures.

FIGS. 5 and 6 show two methods of connecting the wire electrodes 11 in the complex-shaped fibers 27 to form two leads to power the lamp. FIG. 5 shows a method of connecting the wire electrodes in parallel with leads 11*p*1 and 11*p*2. FIG. 6 shows a method of connecting the wire electrodes in series with leads 11*s*1 and 11*s*2. FIGS. 5 and 6 depict a wiring diagram for complex-shaped fibers 27 with two wire electrodes in a single glass fiber and the plasma is ignited in the plane of the glass substrate 16. FIGS. 12 and 14 schematically show two orthogonal arrays of complex-shaped fibers with wire electrodes in both glass structures. In this case, the electrodes in the lamp could also be wired together in either a parallel or series connection, however, the plasma would be ignited perpendicular to the plane of the glass fiber arrays, instead of in the plane of the lamp.

Figure 7:
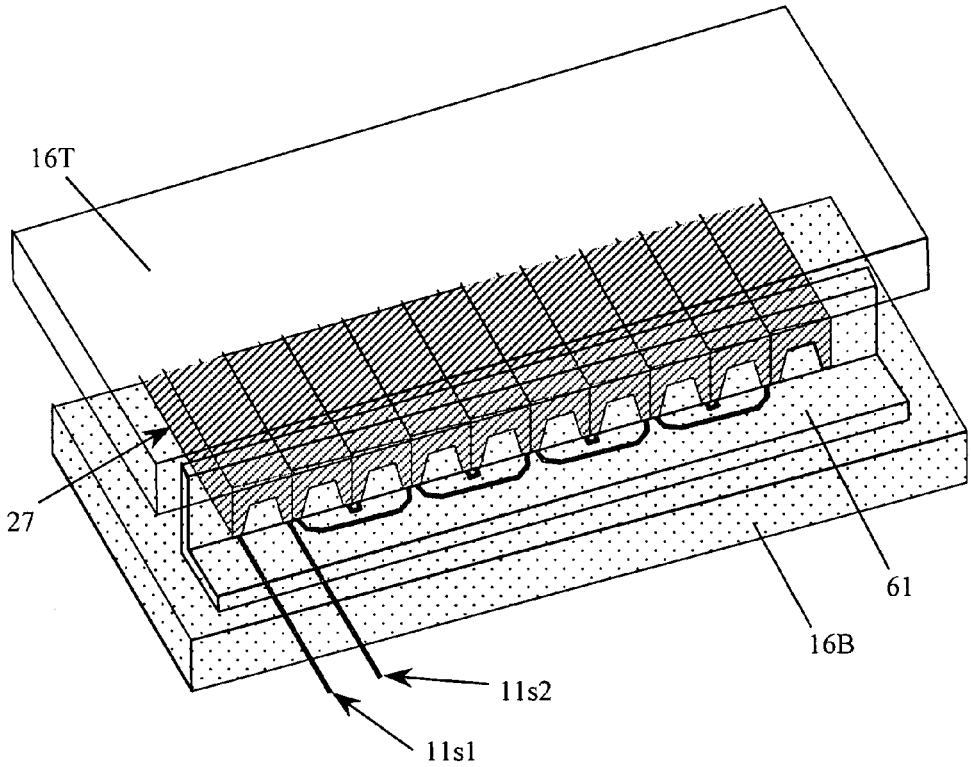
FIG. 7 schematically shows an array of complex-shaped fibers composed on a glass substrate sealed with glass frit and a glass tab on one end of the fluorescent lamp.
Figure 8:
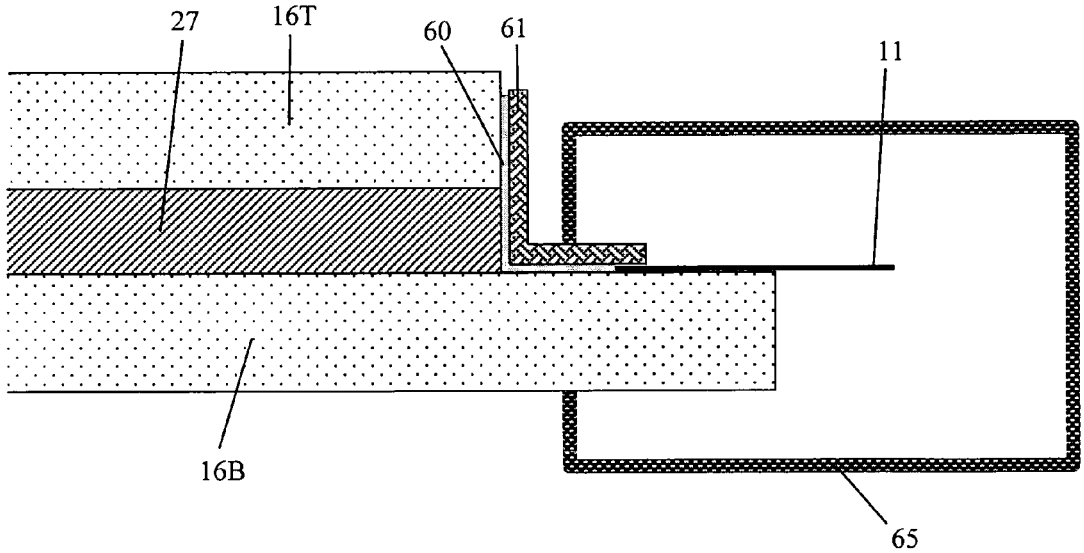
FIG. 8 schematically shows a side view of FIG. 7 during the frit sealing process step.

FIGS. 7 and 8 show a method of hermetically sealing the ends of the complex-shaped fiber arrays 27 using glass tabs 61 and glass frit 60. In the frit sealing process, an L-shaped glass tab 61 containing glass frit 60 is clamped to the glass substrate 16B over the wire electrodes 11 at the end of the complex-shaped fiber array 27 using a high temperature spring clamp 65. During the high temperature process step, the glass frit flows and produces a hermetic seal between the bottom glass substrate 16B, glass tab 61, and the top glass substrate 16T. The glass frit 60 also flows over the wire electrode 11 electrically isolating them from each other. The glass tabs 61 with glass frit 60 can be clamped around the entire lamp to create a hermetic seal between the top 16T and bottom 16B glass substrates. The glass tabs 61 to seal the lamp can take on any shape in order to force the frit 60 to flow and hermetically seal the lamp. Once the lamp is hermetically sealed around its perimeter, it can be gas processed to produce an operational lamp. Gas processing consist of evacuating the lamp using an evacuation port, not shown, while heating the lamp to drive off any contamination in the lamp. The lamp is then backfilled with a plasma gas, typically Xenon or Mercury, and the evacuation port is sealed closed. When an high voltage AC signal is applied to the wire electrodes a plasma is ignited between the electrodes creating UV light. The UV light is absorbed by the phosphor 23 and is converted to visible light or fluoresces.

Figure 9:
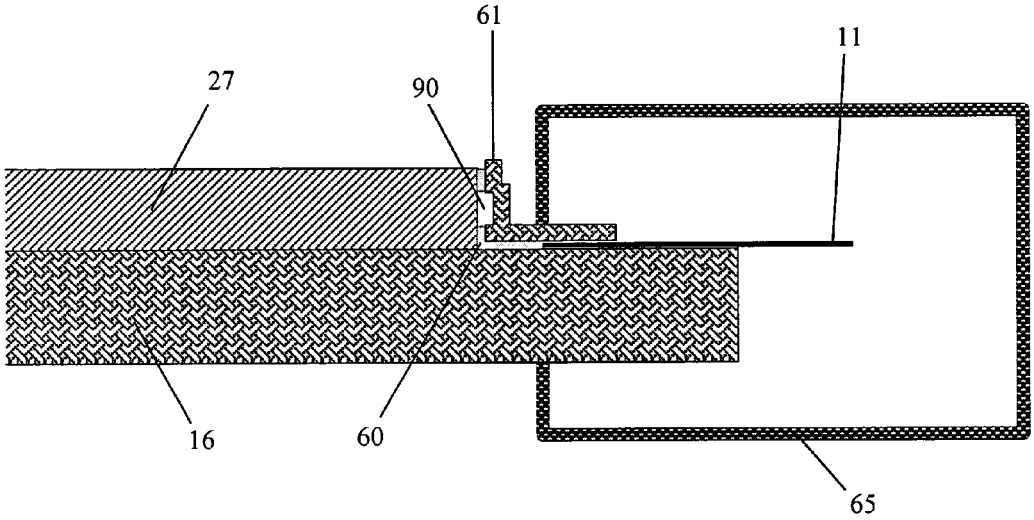
FIG. 9 schematically shows a side view of a flat complex-shaped fiber array fluorescent lamp with structure in the glass sealing tabs at the end to allow gas to flow from one fiber to the next.
Figure 10:
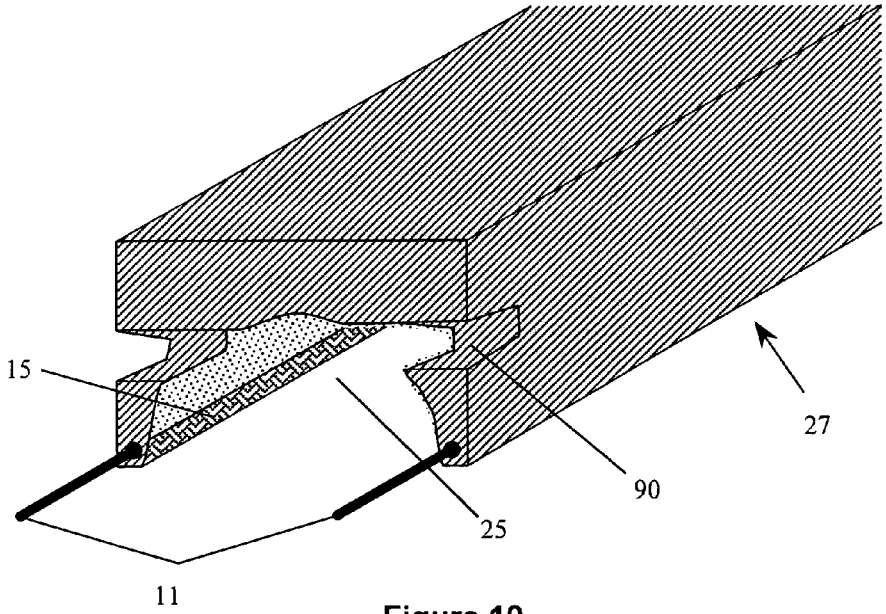
FIG. 10 schematically shows a complex-shaped fiber cut at the end of the structure such that gas can flow from one structure to the next.

One potential problem in producing a fluorescent lamp with a complex-shaped fiber array 27 shown in FIG. 7 is the ability of the plasma gas to flow from one complex-shaped fiber 27 to the next. One method to solve this gas flow problem is to add a recess 90 to the glass tab 61 at the end of the complex-shaped fiber 27, as shown in FIG. 9. This recess 90 will allow the gas to flow from one glass structure 27 to the next. Another method is to cut a groove 90 in the end of the complex-shaped fiber 27 so the gas can flow from one fiber to the next, as shown in FIG. 10. Another method would be to add spacers between the complex-shaped fibers 27 and the glass substrate 16. The spacers would raise the complex-shaped fibers 27 up form the glass substrate 16 allowing for a path for the gas to flow.

Figure 11:
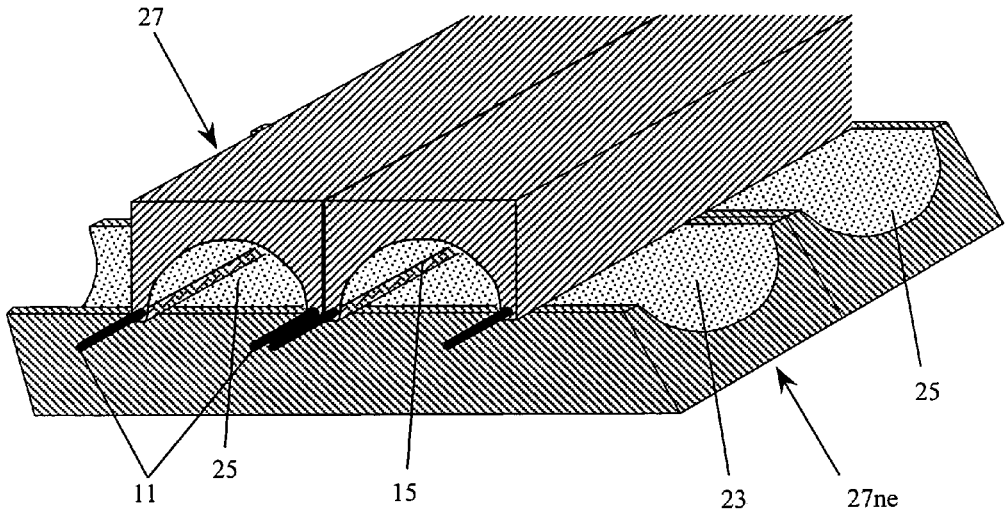
FIG. 11 schematically illustrates a fluorescent lamp composed of two orthogonal complex-shaped fiber arrays with the electrodes contained in one arrayt of fibers.

FIG. 11 shows the structure of a fluorescent lamp composed of two orthogonal arrays of complex-shaped fibers. In this example not only can the gas flow from one complex-shaped fiber to the next, but the plasma can easily spread from one plasma cell region to the next. This easy spreading of the plasma will create a much more uniform glow in the fluorescent lamp. FIG. 11 shows a top complex-shaped fiber array 27 containing a plasma cell region and paired wire electrodes 11 placed over top of and orthogonal to a second complex-shaped fiber 27*ne* without electrodes, but containing a plasma cell region 25. FIG. 12 also shows the structure of a fluorescent lamp composed of two orthogonal arrays of complex-shaped fibers. Both glass structures 27 making up the arrays are identical and contain a plasma cell region 25 as well as wire electrodes 11. One major difference in the two lamps in FIGS. 11 and 12 is the lack of an emissive layer 15 in the lamp shown in FIG. 12. Firing onto a phosphor-coated region, as would be the case in the lamp shown in FIG. 12, usually increases the operating voltage of the lamp and shortens its operating lifetime. However, if the lamp were operated at a high enough frequency, such that there are always electrons and/or ionized species present to support the plasma, a low firing voltage would be obtained.

Figure 13:
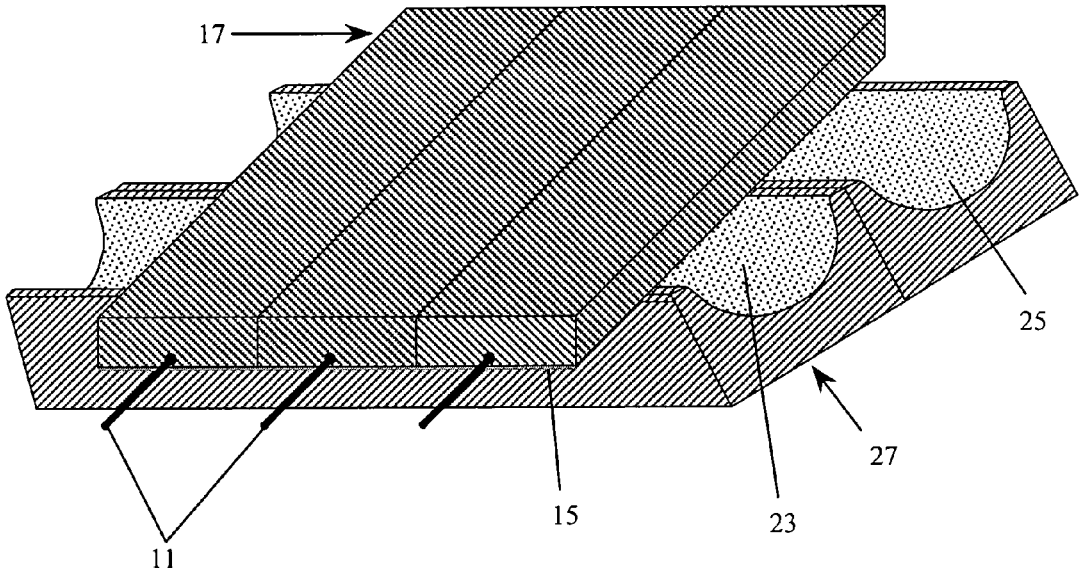
FIG. 13 schematically illustrates a fluorescent lamp composed of two orthogonal complex-shaped fiber arrays with the electrodes contained in one set of glass structures and the plasma channel formed by the other set of glass structures.

FIGS. 13 and 14 show a fluorescent lamp composed of two arrays of complex-shaped fibers with one array of glass structures 27 forming the plasma cell regions 25 in the lamp. FIG. 13 shows a lamp configuration where the top complex-shaped fiber array 17 contains both sets of wire electrodes 11 and the bottom complex-shaped fiber array 27 forms the plasma cell regions 25. FIG. 14 shows a lamp configuration where the top complex-shaped fiber array 17 contains one set of wire electrodes 11 and the bottom complex-shaped fiber array 27 contains the other set of wire electrodes 11 and the plasma cell regions 25. A thin hard emissive film 15, such as magnesium oxide, is deposited on the surface of the top complex-shaped fibers 17 to enhance the secondary electron emission and reduce sputtering from ion bombardment over the electrode region.

Figure 15:
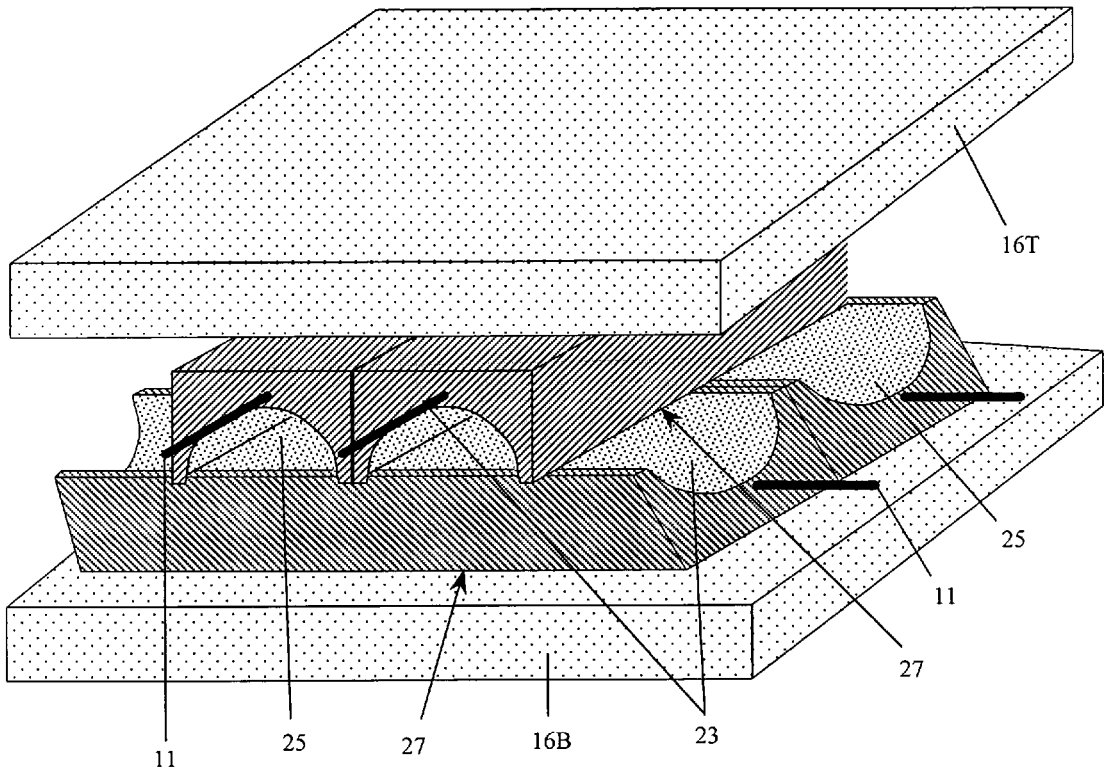
FIG. 15 schematically illustrates a fluorescent lamp similar to that shown in FIG. 12 where the two orthogonal fiber arrays are sandwiched between two glass plates which form the vacuum vessel for the lamp.

FIG. 15 shows the two orthogonal complex-shaped arrays 27 sandwiched between two glass plates 16 to from a vacuum vessel for the lamp. As stated above, the top 16T and the bottom 16B plates would have to be frit sealed around the perimeter to form the vacuum vessel of the lamp.

Figure 16:
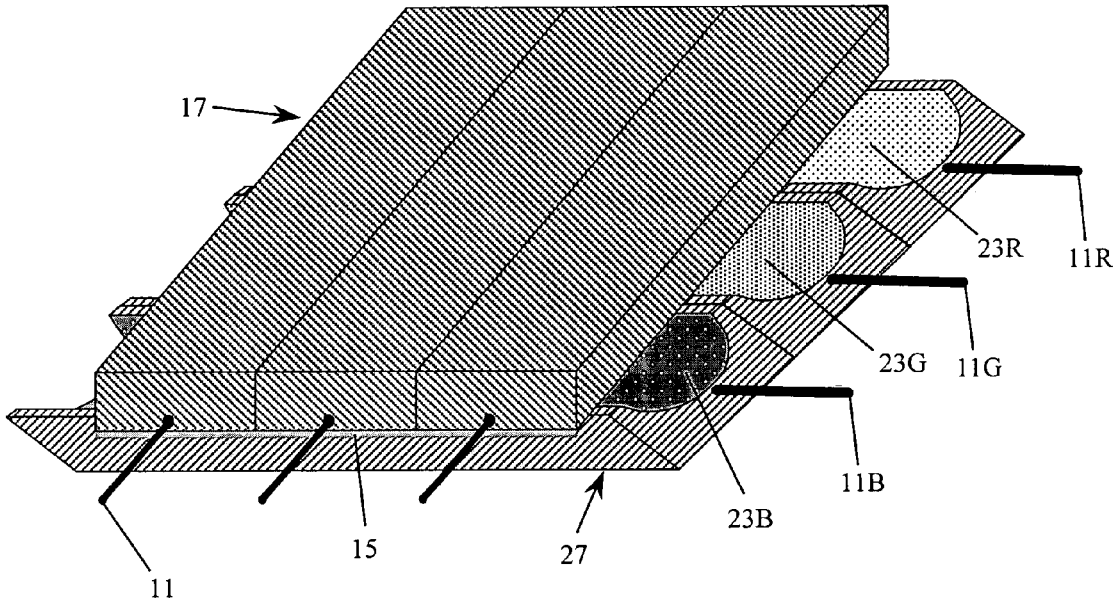
FIG. 16 schematically illustrates a fluorescent lamp composed of complex-shaped fibers that form the plasma channels that are coated with red, green and blue phosphors.

In order to produce a decorative fluorescent lamp, such as a lampshade, alternating phosphor colors can be deposited in the plasma channels 25. FIG. 16 shows a lamp constructed of two orthogonal complex-shaped fiber arrays 17 and 27 with red 23R, green 23B, and blue 23B phosphor layers coated in the channel 25 of the bottom glass structures. These phosphor 23 coated channels 25 can be spray coated then arranged in sequencing RGB order.

Different colors can be obtained from the lamp by applying different high voltage AC pulses to each of the three wire electrodes 11R, 11B, and 11C below their primary color phosphor coated channels. The high voltage AC signals are applied between the wire electrodes 11 in the top fiber array 11 and the color bottom fiber electrodes 11R, 11G and 11B. To achieve a larger pallet of luminescent colors, the duty cycle of the high voltage pulses applied to the color bottom fiber electrodes 11R, 11G and 11B is controlled to regulate the amount of UV generated in the corresponding channel 25 that is used to create fluorescence from the phosphors 23R, 23G and 23B. In a preferred embodiment, the lamp is controlled by a dimmer switch for each color, creating mood lighting.

Figure 17:
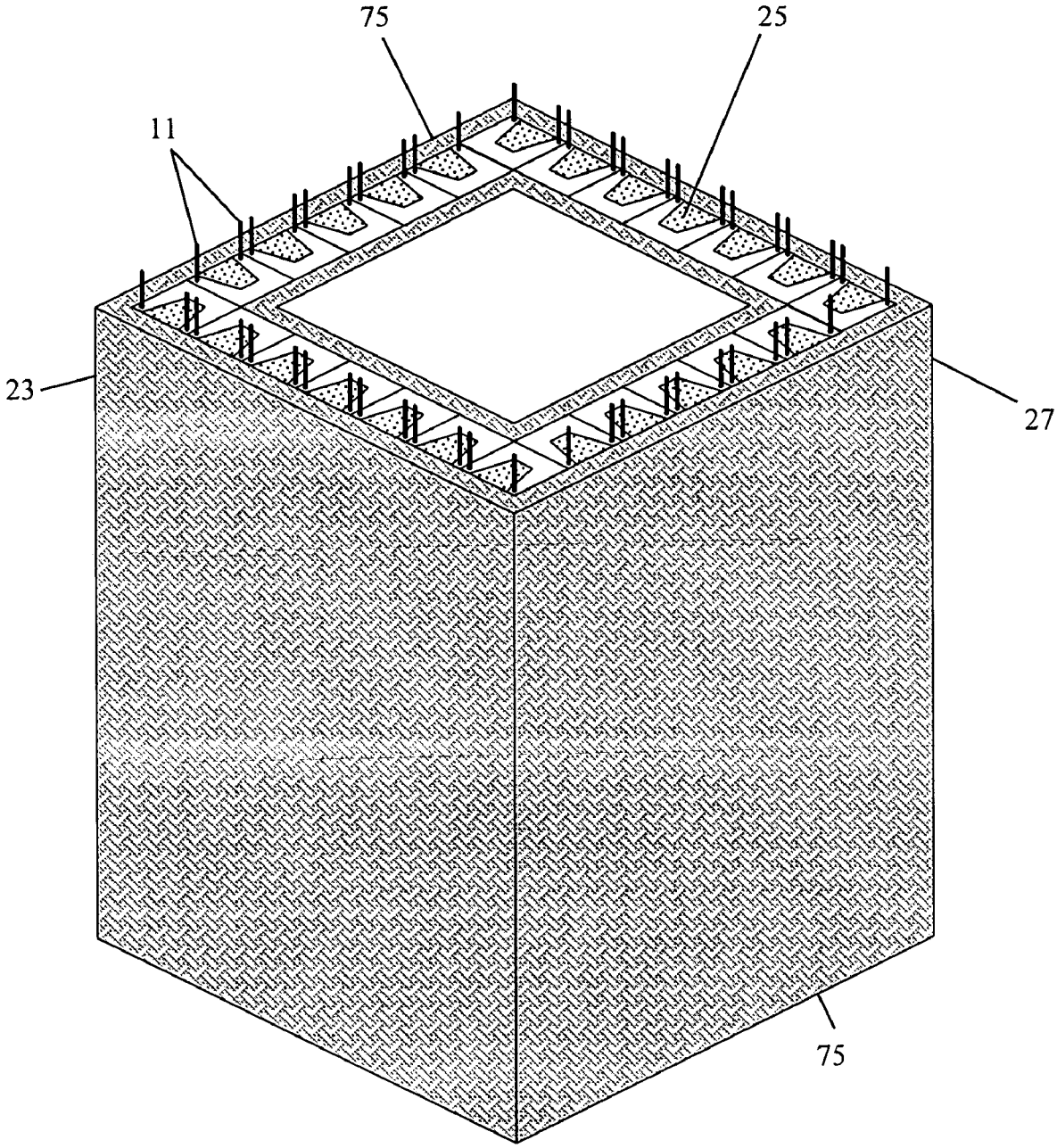
FIG. 17 schematically illustrates a rectangular fluorescent lamp shade constructed using complex-shaped fibers with wire electrode.
Figure 18:
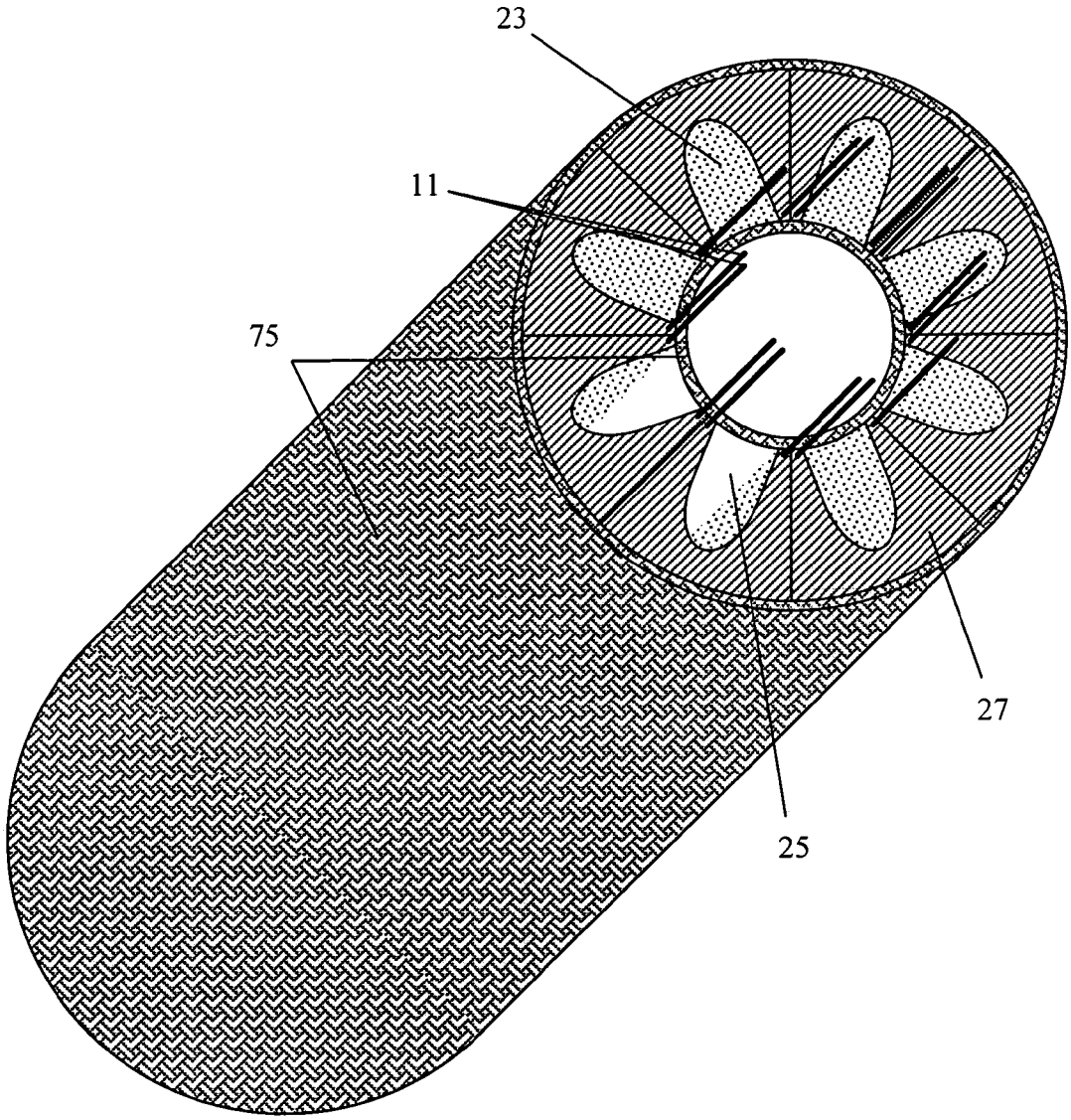
FIG. 18 schematically illustrates a cylindrical tube fluorescent lamp constructed using complex-shaped fibers with wire electrodes.

FIG. 17 shows a rectangular fluorescent lamp composed of two rectangular glass sleeves 75 with complex-shaped fibers 27 arrayed between the glass sleeves 75 to form a lamp. Choosing small or few complex-shaped fibers 27 will produce compact fluorescent, whereas many and/or large glass structures 27 will produce a large fluorescent lamp that could serve as an illuminated lampshade. Changing the shape of the complex-shaped fibers 27 will allow for the fabrication of a cylindrical fluorescent lamp, as shown in FIG. 18. This cylindrical lamp could also be designed as a compact fluorescent or an illuminated lampshade. A glass coated metal wire or a thin small glass structure containing a wire electrode could be wrapped around a curved surface to create a curved fluorescent lamp.

Figure 19:
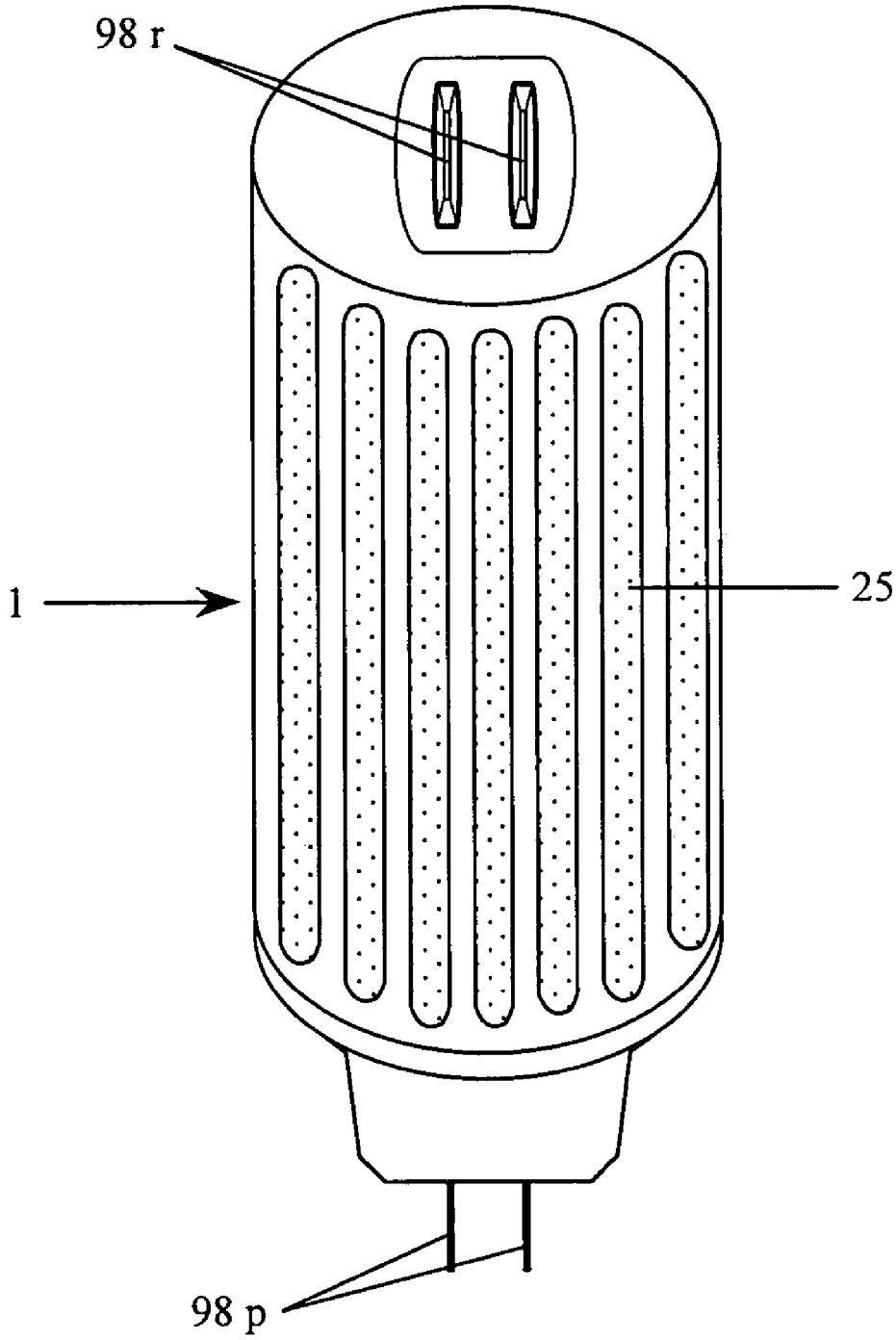
FIG. 19 schematically shows a fluorescent lamp with a plug on one end and a receptacle on the other end.

FIG. 19 shows a compact fluorescent 1 with an electrical plug 98*p* on one end and an electrical receptacle 98*r* on the other end. Using a solid structured member, such as could be formed with glass cylinders 75 and complex-shaped fibers 27, to form the compact fluorescent would give the structure enough strength for an electrical receptacle on one end of the lamp.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A fluorescent lamp comprising:

a) at least one array of complex-shaped glass fibers; wherein at least one surface of at least one complex-shaped glass fiber is curved to form a plasma channel; and b) at least one wire electrode embedded in at least one complex-shaped glass fiber;

such that the array of complex-shaped glass fibers and the wire electrode form the fluorescent lamp.

2. The lamp of claim 1, wherein the channel is coated with a phosphor layer to create white light.

3. The lamp of claim 1, wherein the channel is coated with a phosphor layer to impart color in the lamp.

4. The lamp of claim 1, wherein the channel is spray coated with a phosphor layer.

5. The lamp of claim 1, wherein part of the fiber is coated with an emissive film.

6. The lamp of claim 1, wherein the wire electrodes in the fiber array are wired in parallel.

7. The lamp of claim 1, wherein the wire electrodes in the fiber array are wired in series.

8. The lamp of claim 1, wherein the electricity is capacitively coupled to the plasma through a portion of the fiber from the wire electrode.

9. The lamp of claim 1, wherein at least a portion of at least one fiber contains an opal glass to reflect at least 5% of any light generated entering the opal region.

10. The lamp of claim 1, wherein a reflective coating is applied to the channel to reflect at least 5% of any light generated entering the coating.

11. The lamp of claim 1, wherein the ends of the array are covered with a glass frit to hermetically seal the lamp.

12. The lamp of claim 11, wherein the frit is forced to flow using glass tabs.

13. The lamp of claim 11, wherein the frit covers the wire electrodes to electrically isolate the wires from each other.

14. The lamp of claim 1, wherein the array of complex-shaped fibers is sandwiched between two glass plates.

15. The lamp of claim 14, wherein the two glass plates are hermetically sealed around their parameter and backfilled with a plasma gas to form a fluorescent lamp.

16. The lamp of claim 1, further comprising adding a glass frit to the sides of the complex-shaped fibers to hermetically seal them together to form a hermetically sealed surface of the lamp.

17. The lamp of claim 1, wherein the wire electrode embedded within the at least one complex-shaped fiber has been exposed to an environment outside the fiber using a lost glass process.

18. The lamp of claim 1, wherein the shape of the fiber is altered using a lost glass process.

19. The lamp of claim 1, wherein at least one fiber is bent onto a curved surface.

20. The lamp of claim 1, wherein the lamp serves as a compact fluorescent lamp.

21. The lamp of claim 1, wherein the lamp serves as an illuminated surface.

22. The lamp of claim 1, wherein the lamp serves as a lampshade.

23. The lamp of claim 1, wherein the lamp comprises a plug on one end of the lamp and a receptacle on the other end of the lamp.

24. The lamp of claim 1, wherein the channels in the array are sequentially coated with at least one red phosphor, at least one green phosphor and at least one blue phosphor.

25. The lamp of claim 24, wherein the phosphors can be independently illuminated to create a lamp which luminesces in a plurality of colors.

26. The lamp of claim 1, wherein the wire electrode extends over 50% of the length of the fiber.

* * * * *